US005173046A

United States Patent [19]

Walker

[11] Patent Number: 5,173,046

[45] Date of Patent: Dec. 22, 1992

[54] APPARATUS FOR TREATING THE EXTERIOR SURFACE OF PLASTIC CONTAINERS

[76] Inventor: Stuart M. Walker, 860 Carver Blvd., Toledo, Ohio 43607

[21] Appl. No.: 504,578

[22] Filed: Apr. 4, 1990

[51] Int. Cl.[5] ..... F27B 9/14

[52] U.S. Cl. ..... 432/121; 432/10; 432/11; 432/124; 432/141; 432/225; 34/105

[58] Field of Search ..... 432/225, 226, 227, 229, 432/230, 231, 232, 10, 11, 19.59, 124, 141, 121; 34/105

[56] References Cited

U.S. PATENT DOCUMENTS

| | | | |
|---|---|---|---|
| 2,648,097 | 8/1953 | Kritchever . | |
| 2,656,170 | 10/1953 | Mann | 432/11 |
| 2,683,894 | 7/1954 | Kritchever . | |
| 2,795,820 | 6/1957 | Glow et al. . | |
| 3,017,339 | 1/1962 | Dewey . | |
| 3,182,103 | 5/1965 | Blaylock et al. . | |
| 3,472,499 | 10/1969 | Burch | 432/11 |
| 3,755,916 | 9/1973 | Gulaian | 34/105 |
| 3,761,550 | 9/1973 | Seefluth | 432/10 |
| 3,796,885 | 3/1974 | Shofner . | |
| 3,905,758 | 9/1975 | Moussou et al. | 432/11 |
| 3,977,091 | 8/1976 | Hortig et al. | 34/105 |
| 4,050,888 | 9/1977 | Pfister et al. | 34/105 |
| 4,052,152 | 10/1977 | Whelan et al. | 34/105 |
| 4,053,993 | 10/1977 | Schregenberger | 34/105 |
| 4,079,104 | 3/1978 | Dickson et al. | 432/11 |
| 4,165,966 | 8/1979 | Whelan et al. | 34/105 |
| 4,193,204 | 3/1980 | Nerod | 34/105 |
| 4,571,173 | 2/1986 | Chang et al. | 432/11 |

*Primary Examiner*—Henry C. Yuen
*Attorney, Agent, or Firm*—William J. Clemens

[57] ABSTRACT

An apparatus for flame treating an exterior surface of a plastic container such as a barrel includes a carriage mounted on a frame for rotatably supporting a plastic container, a first treatment station attached to the frame for flame treating a facing end of the container and a second treatment station attached to the frame for flame treating the sides of the container. The carriage is attached to a cable driven by a first actuator for moving the carriage from a starting position for loading the container onto the carriage past the first station to the second station and back to the starting position. The carriage, a burner at the second station and a roller for rotating the container at the second station are all adjustable for accommodating various diameter containers.

20 Claims, 3 Drawing Sheets

APPARATUS FOR TREATING THE EXTERIOR SURFACE OF PLASTIC CONTAINERS

BACKGROUND OF THE INVENTION

The present invention relates generally to an apparatus for treating the exterior of plastic containers and, in particular, to an apparatus for flame treating the exterior of plastic barrels.

U.S. Pat. No. 2,648,097 discloses a method of treating the surface of polyethylene sheets utilizing a gas flame for a short period of time. A flame at 3600° F. is preferred to soften the plastic which is then allowed to harden forming a surface highly receptive to common ink and various coating compositions. There is shown a straight manifold burner for the treatment of a plastic sheet and a ring manifold burner through which a plastic bottle is passed for flame treatment of its external surface.

U.S. Pat. Nos. 2,683,894 and 2,795,820 both disclose means for treating sheet polyethylene utilizing a flame for providing a printing surface. U.S. Pat. No. 3,017,339 discloses the treatment of the external surface of thermoplastic tubing by corona discharge for the reception of protective and decorative coatings, printing inks, adhesives and the like. U.S. Pat. No. 3,182,103 discloses the treatment of plastic bottles by electrostatic discharge for the reception of a surface coating. U.S. Pat. No. 3,796,885 shows the treatment of plastic rod or tube by spark discharge for receiving a protective or decorative coating.

SUMMARY OF THE INVENTION

The present invention concerns an apparatus for flame treating plastic containers such as barrels. A barrel is loaded onto a carriage which carriage is then moved past a first treatment station to a second treatment station. When the carriage is in position at the first treatment station, a proximity sensor signals a first burner to start and a first timer shuts off the first burner after a predetermined time has expired. The first burner is a straight manifold type which extends vertically adjacent one end of the barrel as it passes.

The carriage continues to travel to the end of its path adjacent a second treatment station. A second straight manifold burner extending horizontally is turned on by a second timer for a second predetermined time period and the side of the barrel is rotated in front of the burner. When the second burner is turned off, the barrel is ejected and the carriage returns to its home position to receive another barrel.

The carriage is attached to a cable driven by a first actuator for moving the carriage from a starting position for loading the barrel onto the carriage past the first station to the second station and back to the starting position. The carriage, a burner at the second station and a roller for rotating the barrel at the second station are all adjustable for accommodating various diameter barrels.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
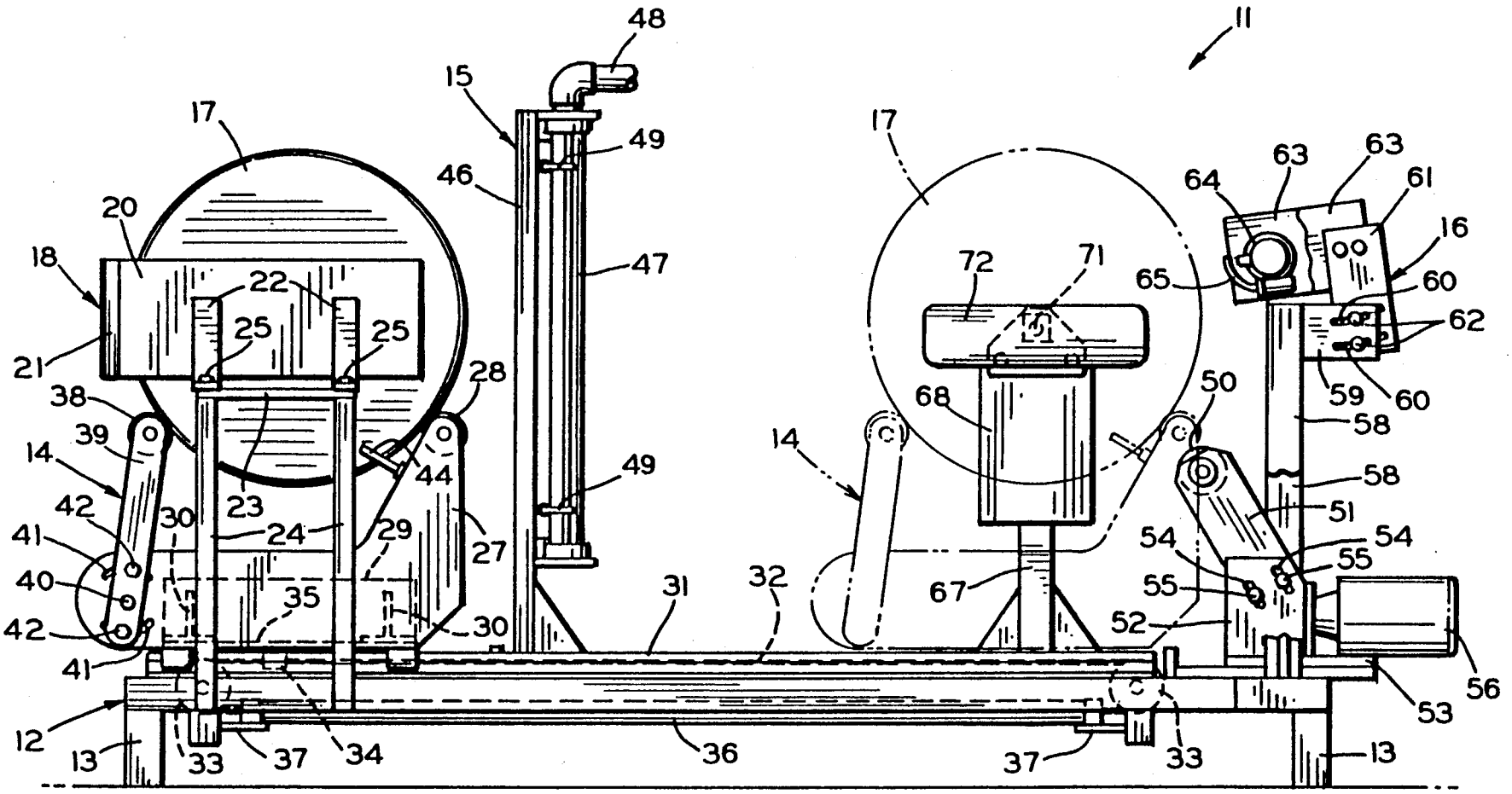
FIG. 1 is a front elevational view of an apparatus for treating containers in accordance with the present invention.
Figure 2:
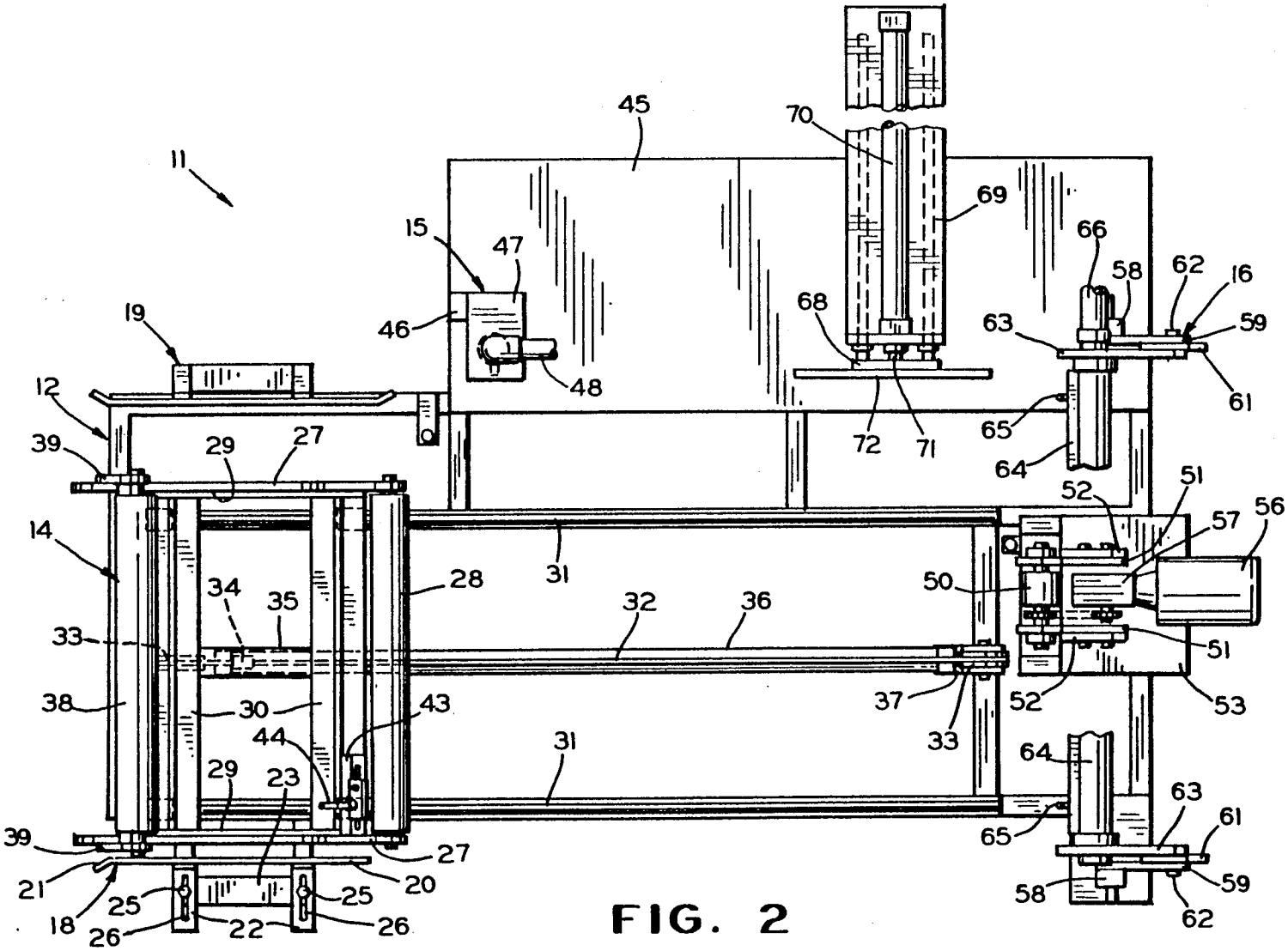
FIG. 2 is a top plan view of the container treatment apparatus shown in FIG. 1.

An apparatus 11 for treating the exterior surface of plastic containers such as barrels is shown in FIGS. 1 and 2. A generally rectangular, horizontally extending frame 12 has a ground in engaging leg 13 attached to each corner of thereof (only two are shown in FIG. 1). The frame 12 supports a carriage 14 shown in a home or starting position at the left side of the apparatus 11. As will be discussed below, the carriage 14 is automatically moved toward the right side of the apparatus 11, past a first treatment station 15 to a position shown in phantom in FIG. 1 adjacent a second treatment station 16.

The apparatus 11 flame treats the exterior surface of one end and the sides of generally cylindrical barrels. A plurality of such barrels can be delivered to the left side of the apparatus 11 by a conveyor (not shown) for loading the barrels onto the carriage 14. A barrel 17 is shown loaded onto the carriage 14 in FIG. 1. The barrel 17 is not shown in FIG. 2 in order to provide a better view of the carriage 14.

The carriage 14 is positioned between a pair of generally upstanding, spaced apart guide rails 18 and 19. The guide rail 18 is attached to the front side of the frame 12. A guide plate 20 extends in a generally vertical plane and has leading edge 21 which is outwardly bent along a vertical axis. The end 21 prevents the barrel 17 from catching or hanging up on the guide plate 20 as the barrel is loaded into the carriage and as the carriage moves toward the first treatment station 15. A pair of generally L-shaped brackets 22 each have a generally vertically extending leg attached to an outer surface of the guide plate 20. A generally horizontally extending leg of each of the brackets 22 rests on an horizontally extending base 23. The base 23 is supported by a pair of spaced apart generally vertically extending legs 24, each of the legs 24 having an upper end attached to an opposite end of the base 23 and a lower end attached to the frame 12.

A pair of threaded fasteners 25 threadably engage threaded apertures (not shown) formed in the base 23. Each of the generally horizontally extending legs of the brackets 22 has an elongated slot 26 formed therein through which the fasteners 25 extend. Thus, when the fasteners 25 are loosened, the guide plate 20 can be moved toward and away from the front side of the frame 12 to provide an adjustable stop for one end of the barrel 17. This adjustment means permits the apparatus 11 to accommodate various lengths of barrels. The guide rail 19 is similar in construction to the guide rail 18, but does not include the adjustment means such that it remains in a fixed position at the rear side of the frame 12 and has both ends bent outwardly.

The carriage 14 includes a pair of generally L-shaped end plates 27 each extending in a generally vertical plane. A first generally horizontally extending roller 28 has its opposite ends rotatably mounted at the upper end of the general vertically extending portion of each of the end plates 27. The end plates 27 are each connected on facing surfaces to associated ones of a pair of attachment plates 29. The attachment plates 29 are connected to opposite ends of a pair of inverted T-shaped beams 30.

The carriage 14 is slidably mounted on a pair of tracks 31 or rails such as Thompson bearings. The rails 31 extend from the left end of the frame 12 to a position adjacent the second treatment station 16. The carriage 14 is moved along the rails by a drive means such as a cable 32 extending between the rails and around a pair of pulleys 33 rotatably mounted at opposite ends of the frame 12. The carriage 14 is connected to the cable 32 by a clamp 34 which engages the cable and is attached to the underside of a beam 35 extending between the beams 30. The ends of the cable 32 extend into opposite ends of an actuator 36. The opposite ends of the actuator 36 rest upon support brackets 37 which extend between and underneath the front and rear sides of the frame 12. The actuator 36 is formed as an elongated tube having a piston (not shown) slidably retained therein with the opposite ends of the cable 32 attached to opposite ends of the piston. The piston can be moved in the tube by applying actuating fluid such as compressed air. When the carriage 14 located at the left side of the frame 12, the piston is positioned at the end of the actuator 36 adjacent the second treatment station 16.

The barrel 17 is supported on the roller 28 and a similar generally parallel roller 38 rotatably attached to the upper ends of a pair of arms 39. Each of the arms 39 is rotatably attached at 40 to the associated one of the end plates 27. Each of the end plates 27 has a pair of semi-circular slots 41 formed therein about the attachment point 40 as a center point. A pair of fasteners 42 are attached to each of the arms 39 and extend through the slots 41 to provide an adjustment means to accommodate different diameters of barrels. A bracket 43 is mounted on the interior surface of the end plate 27 closer to the front side of the frame 12 and mounted on the bracket is a guide cylinder 44 for the barrel. The barrel guide cylinder 44 engages the front end of the barrel 17 and determines the axial position of the barrel on the carriage 14.

Along the rear edge of the frame 12, there is attached a generally horizontally extending planar base 45. At the left side of the base 45, a generally vertically extending post 46 is attached thereto forming a portion of the first treatment station 15. Attached to the post 46 is a vertically extending straight manifold burner 47. Attached to an inlet at the upper end of the burner 47 is a gas supply line 48. The burner 47 is provided with a pair of ignitors 49.

In FIG. 1, the carriage 14 and the barrel 17 are shown in phantom positioned adjacent the second treatment station 16. The station 16 includes a drive roller 50 rotatably mounted at the upper ends of a pair of arms 51. The lower ends of the arms 51 are attached to a pair of spaced apart, generally vertically extending mounting plates 52. The lower edges of the mounting plates 52 are attached to a base plate 53 which in turn is attached to the frame 12. A pair of generally parallel angled slots 54 are formed in each of the mounting plates 52 to receive fasteners 55 which extend through the slots 54 and engage the mounting arms 51. Thus, the position of the roller 50 can be adjusted for different diameter barrels.

The drive roller 50 is driven in rotation by any suitable means such as an electric motor 56 mounted on the base plate 53. The motor 56 typically drives a speed reduction gear box 57 which in turn rotates the drive roller 50 through any suitable means such as a chain and a pair of sprockets or a belt and a pair of pulleys.

A pair of spaced apart, generally vertical posts 58 each have a lower end attached to the frame 12. At the upper end of each of the posts 58 there is attached a mounting plate 59 having a pair of generally parallel semi-circular slots 60 formed therein. A pair of mounting arms 61 each have lower ends attached to one of the mounting plates 59 by a pair of fasteners 62 extending through associated ones of the slots 60. Attached to an upper end of each of the arms 61 is one of a pair of mounting plates 63. Extending between and attached to the mounting plates 63 is a second straight manifold burner 64 provided with a pair of ignitors 65. The burner 64 is supplied with fuel through a gas supply line 66 connected to an inlet formed in one end of the burner.

Also mounted on the base plate 45 is a generally vertically extending post 67. Attached to an upper end of the post 67 is a mounting plate 68. Extending generally horizontally rearwardly from the mounting plate 68 is a support plate 69. Mounted on an upper surface of the plate 69 is an actuator cylinder 70. Enclosed within the cylinder of the actuator 70 is a piston (not shown) which includes an actuating rod 71 extending through the mounting plate 68. The exposed end of the rod 71 is attached to a generally vertically extending ejection plate 72.

The apparatus 11 shown in FIGS. 1 and 2 operates by loading a barrel 17 onto the carriage 14 with the axis of rotation of the barrel in a horizontal orientation. The sides of the barrel 17 are rotatably supported by the rollers 28 and 38. The guide cylinder 44 prevents the barrel 17 from moving forward on the carriage 14. After a predetermined delay, the first actuator 36 is energized and the carriage is moved along the rails 31 past the first treatment station 15. A proximity sensor senses the presence of the carriage 14 and activates a first timer. The timer turns on the ignitors 49 and opens a valve to supply gas through the line 48 to ignite the burner 47. The first timer will determine the period of time for which the burner 47 is turned on, which time period will be of sufficient length to allow the barrel 17 to pass the first treatment station 15 so that all of the rear end of the barrel is flame treated. At the end of the predetermined time, the gas valve associated with the line 48 is turned off thereby extinguishing the burner 47.

The carriage 14 continues to travel down the rails 31 until it reaches the right end of the rails. The carriage 14 is sensed and a second timer is started. The second timer opens a valve to supply fuel through the line 66 to the burner 64 and turns on the ignitors 65. At the same time, the motor 56 is activated to drive the roller 50 which engages the outer surface of the barrel 17 and rotates it on the rollers 28 and 38. Thus, the entire outer surface of the barrel 17 is rotated past the burner 64. At the end of a second predetermined time, the valve is closed to extinguish the burner 64 and the motor 56 is stopped. Next, the barrel guide cylinder 44 is retracted and the barrel eject actuator 70 is actuated to push the barrel in the direction of its axis of rotation off the front end of the carriage 14 to a conveyor (not shown). The second actuator 70 is retracted and the first actuator 36 is operated in the opposite direction to return the carriage 14 to the starting position at the left end of the frame 12. When the carriage reaches the starting position, another barrel can be automatically loaded onto the carriage and the cycle repeated.

Figure 3:
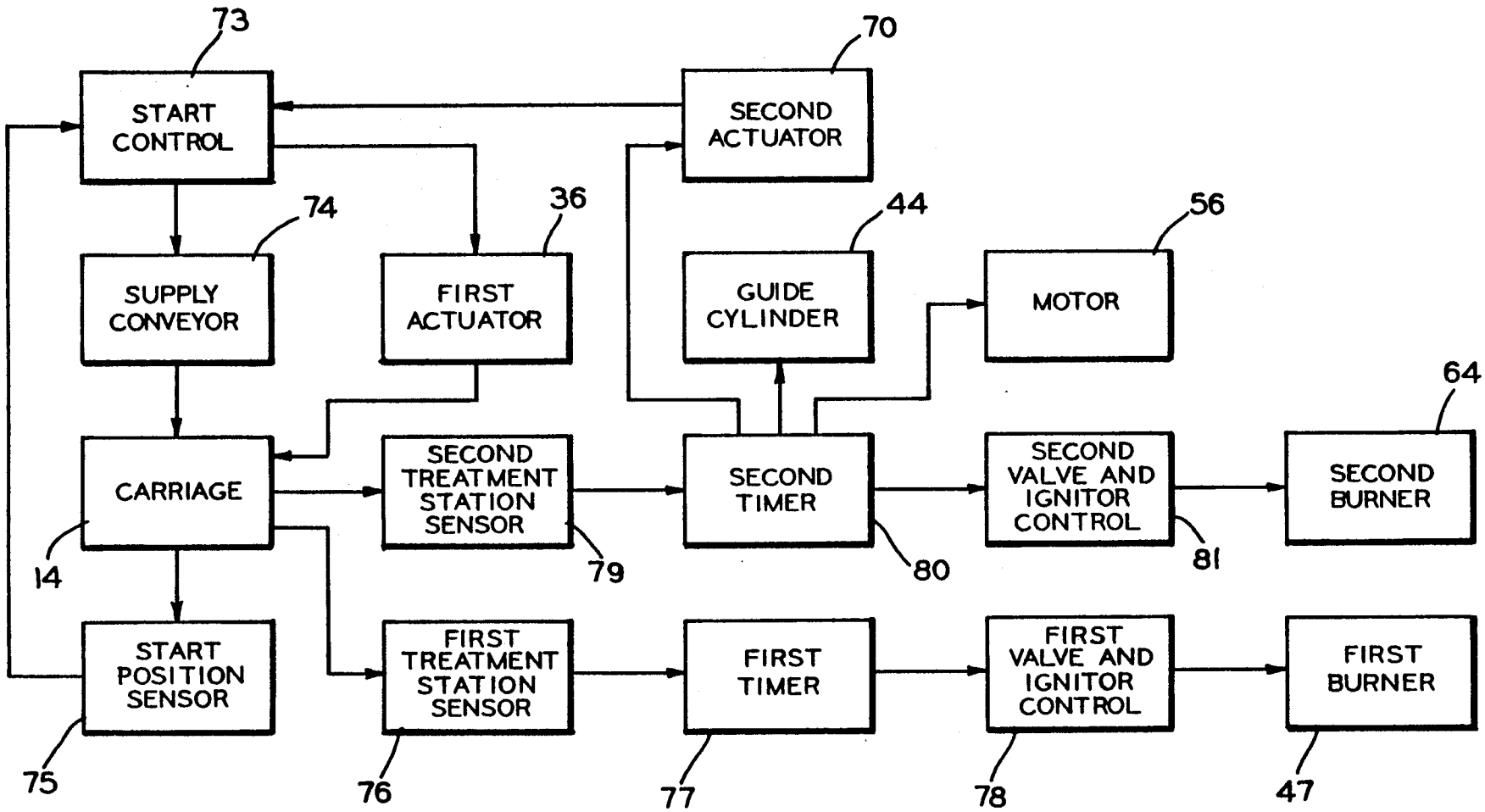
FIG. 3 is a schematic block diagram of the control system for the apparatus shown in FIGS. 1 and 2.

Fuel valves, electrical and pneumatic lines, and various control elements have been eliminated from FIGS. 1 and 2 in order not to obscure the various mechanical portions of the apparatus 11. There is shown in FIG. 3 a schematic block diagram of the control portions of the apparatus 11. A start control 73 can be a push button or the like which is actuated to generate a control signal to a supply conveyor 74. The supply conveyor 74 responds to the control signal by loading a barrel onto the carriage 14. A start position sensor 75 can be provided to sense the presence of the carriage 14 at the left end of the rails 31 and provide an enabling signal to the start control 73. After a delay, the start control 73 generates a control signal to activate the first actuator 36 to move the carriage 14 along the rails 31 past the first treatment station 15. A sensor 76 located at the first treatment station 15 responds to the presence of the carriage 14 and generates a start signal to a first timer 77. The first timer 77 generates control signals to a first valve and ignitor control 78 to provide gas to the gas line 48 and to start the ignitors 49 thereby igniting the first burner 47. When the first timer 77 times out after a first predetermined time interval, the first valve and ignitor control 78 is turned off which closes the associated valve to extinguish the first burner 47.

A second treatment station sensor 79 is provided adjacent the second treatment station 16 for sensing the presence of the carriage 14. The second sensor 79 generates a start signal to a second timer 80 which in turn generates a start signal to a second valve and ignitor control 81. The second control 81 responds by opening an associated valve to supply gas to the second burner 64 through the line 66 and turning on the ignitor 65. After a second predetermined time interval, the second timer 80 will turn off the second control 81 which closes the associated valve thereby extinguishing the second burner 64. At the same time that the second timer 80 turns on the second control 81, it also activates the motor 56 to rotate the barrel 17. When the second control 81 is turned off, the motor 56 is also turned off.

Next, the second timer 80 generates a signal to the guide cylinder 44 to retract thereby unblocking the barrel 17. The second timer 80 then generates a signal to the second actuator 70 to eject the barrel from the carriage 14. When the second actuator 70 has retracted, a signal is sent to the start control 73 to start the first actuator 36 in the opposite direction to return the carriage 14 to the start position. The start position sensor 75 senses the presence of the carriage 14 at the left end of the tracks 31 and signals the start control 73 to actuate the supply conveyor 745 to provide another barrel. Thus, the control circuit shown in FIG. 3 will automatically cycle the apparatus 11 as long as barrels are provided by the supply conveyor 74.

In summary, the invention concerns an apparatus for flame treating an exterior surface of a plastic container including a ground engaging frame; a carriage mounted on said frame for rotatably supporting a plastic container with its axis of rotation in a horizontal plane; a first treatment station attached to said frame for flame treating a facing end of the container; a second treatment station attached to said frame for flame treating sides of the container; means mounted on said frame for moving said carriage from a starting position past said first treatment station to said second treatment station and back to said starting position; and means attached to said frame adjacent said second treatment station for ejecting the container from said carriage after treatment.

In accordance with the provisions of the patent statutes, the present invention has been described in what is considered to represent its preferred embodiment. However, it should be noted that the invention can be practiced otherwise than as specifically illustrated and described without departing from its spirit or scope.

I claim:

1. An apparatus for flame treating an exterior surface of a plastic container comprising:

a frame;

a carriage for rotatably supporting a plastic container, said carriage mounted for movement on said frame and having means for engaging an exterior surface of and rotatably supporting the plastic container;

a first treatment station to said frame for flame treating an end of the container;

a second treatment station attached to said frame and spaced from said first treatment station for flame treating sides of the container;

means mounted on said frame for moving said carriage from a starting position past said first treatment station to said second treatment station and moving said carriage from said second treatment station past said first treatment station to said starting position; and means attached to said frame adjacent said second treatment station for ejecting the container from said carriage.

2. The apparatus according to claim 1 wherein said carriage includes a pair of rollers for rotatably supporting the container.

3. The apparatus according to claim 1 wherein said first treatment station includes a generally vertically extending straight manifold burner for flame treating a facing end of the container.

4. The apparatus according to claim 1 wherein said second treatment station includes a generally horizontally extending straight manifold burner for flame treating the sides of the container.

5. The apparatus according to claim 1 wherein said means for moving includes a cable extending along a path of travel for said carriage and attached to said carriage, and an actuator attached to said frame and connected to said cable for moving said carriage from a starting position on said frame to a position adjacent said second treatment station and back to said starting position.

6. The apparatus according to claim 1 wherein said means for ejecting includes an actuator attached to said frame for engaging an end of the container and moving the container off of said carriage.

7. An apparatus for flame treating an exterior surface of a plastic barrel comprising:

a ground engaging generally horizontally extending frame;

a carriage movably mounted on said frame and including means for engaging an exterior surface and for rotatably supporting a plastic barrel;

a first treatment station attached to said frame for flame treating a facing end of the barrel;

a second treatment station attached to said frame and spaced from said first treatment station for flame treating sides of the barrel; and means mounted on said frame for moving said carriage from a starting position past said first treatment station to said second treatment station and from said second treatment station past said first treatment station to said starting position.

8. The apparatus according to claim 7 including means attached to said frame adjacent said second treatment station for ejecting the barrel from said carriage.

9. The apparatus according to claim 7 wherein said carriage includes a pair of rollers for rotatably supporting the barrel and including means for rotating the barrel on said rollers attached to said frame at said second treatment station.

10. The apparatus according to claim 9 including means for adjusting the position of said means for rotating relative to said carriage at said second treatment station.

11. The apparatus according to claim 7 wherein said first treatment station includes a generally vertically extending straight manifold burner for flame treating a facing end of the barrel and wherein said second treatment station includes a generally horizontally extending straight manifold burner for flame treating the sides of the barrel.

12. The apparatus according to claim 7 wherein said second treatment station includes a generally horizontally extending straight manifold burner for flame treating the sides of the barrel and means for adjusting the position of said burner relative to said carriage at said second treatment station.

13. The apparatus according to claim 7 wherein said means for moving includes a cable extending along a path of travel for said carriage about a pair of pulleys attached to said frame, and an actuator attached to said frame and connected to said cable for moving said carriage from a starting position on said frame to a position adjacent said second treatment station and back to said starting position.

14. The apparatus according to claim 7 wherein said carriage includes a pair of generally parallel rollers for rotatably supporting the barrel and means for adjusting the position of one of said rollers with respect to the other one of said rollers.

15. An apparatus for flame treating an exterior surface of a plastic barrel comprising:

a ground engaging frame;

a carriage movably mounted on said frame and having means for engaging an exterior surface of and for rotatably supporting a plastic barrel with the axis of rotation of the barrel in a horizontal plane;

a first treatment station attached to said frame for flame treating a facing end of the barrel;

a second treatment station attached to said frame and spaced from said first treatment station for flame treating sides of the barrel;

means mounted on said frame for moving said carriage from a starting position past said first treatment station to said second treatment station and back to said starting position past said first treatment station; and means attached to said frame adjacent said second treatment station for ejecting the barrel from said carriage.

16. The apparatus according to claim 15 wherein said carriage includes a pair of rollers for rotatably supporting the barrel and including means for rotating the barrel on said rollers attached to said frame at said second treatment station and means for adjusting the position of said means for rotating relative to said carriage at said second treatment station.

17. The apparatus according to claim 15 wherein said first treatment station includes a generally vertically extending straight manifold burner for flame treating a facing end of the barrel and wherein said second treatment station includes a generally horizontally extending straight manifold burner for flame treating the sides of the barrel.

18. The apparatus according to claim 17 wherein said second treatment station includes means for adjusting the position of said horizontally extending burner relative to said carriage at said second treatment station.

19. The apparatus according to claim 15 wherein said carriage includes a pair of generally parallel rollers for rotatably supporting the barrel and means for adjusting the position of one of said rollers with respect to the other one of said rollers.

20. The apparatus according to claim 15 including timer means for turning on a burner at said first treatment station for a first predetermined time as said carriage passes said first treatment station and for turning on a burner at said second treatment station for a second predetermined time when said carriage is adjacent said second treatment station.

* * * * *